US008640827B2

(12) United States Patent
Breithaupt, Jr.

(10) Patent No.: US 8,640,827 B2
(45) Date of Patent: Feb. 4, 2014

(54) ADJUSTABLE SCAFFOLD BASE

(76) Inventor: Justin B. Breithaupt, Jr., Shreveport, LA (US)

( * ) Notice: Subject to any disclaimer, the term of this patent is extended or adjusted under 35 U.S.C. 154(b) by 243 days.

(21) Appl. No.: 13/036,149

(22) Filed: Feb. 28, 2011

(65) Prior Publication Data

US 2011/0297483 A1 Dec. 8, 2011

Related U.S. Application Data

(60) Provisional application No. 61/351,320, filed on Jun. 4, 2010.

(51) Int. Cl.
*E04G 1/00* (2006.01)

(52) U.S. Cl.
USPC ..... 182/182.4; 182/182.1

(58) Field of Classification Search
USPC ..... 182/182.4, 182.1, 17, 152, 186.8; 52/651.1
See application file for complete search history.

(56) References Cited

U.S. PATENT DOCUMENTS

| | | | | | |
|---|---|---|---|---|---|
| 2,430,179 | A | * | 11/1947 | Lanchester | 182/17 |
| 2,435,060 | A | | 1/1948 | Thomson | |
| 2,445,453 | A | * | 7/1948 | Pennington | 182/115 |
| 2,556,611 | A | | 6/1951 | Borgman | |
| 3,032,148 | A | * | 5/1962 | Bank | 52/637 |
| 3,071,204 | A | | 1/1963 | Piltingsrud | |
| 3,245,495 | A | * | 4/1966 | Wells, Jr. | 182/152 |
| 3,266,208 | A | * | 8/1966 | Maggs et al. | 52/651.1 |
| 3,282,376 | A | * | 11/1966 | Merriman | 182/17 |
| 3,503,466 | A | * | 3/1970 | Rosander | 182/13 |
| 3,564,803 | A | | 2/1971 | Breeze et al. | |
| 3,697,032 | A | | 10/1972 | Pearce | |
| 3,923,320 | A | * | 12/1975 | Favreau et al. | 280/103 |
| 4,026,079 | A | | 5/1977 | Morris | |
| 4,064,999 | A | | 12/1977 | Young | |
| 4,134,473 | A | | 1/1979 | Prior | |
| 4,216,933 | A | * | 8/1980 | Cramer, Jr. | 248/188.5 |
| 4,371,057 | A | | 2/1983 | Blier | |
| 4,620,608 | A | * | 11/1986 | Gilbreath | 182/17 |
| 4,782,917 | A | | 11/1988 | Schulz | |
| 4,804,162 | A | * | 2/1989 | Rice | 248/671 |
| 4,877,109 | A | | 10/1989 | Welch et al. | |
| 5,022,490 | A | * | 6/1991 | Wyse | 182/17 |
| RE34,404 | E | * | 10/1993 | Dupont et al. | 182/146 |
| 5,456,334 | A | * | 10/1995 | Brignac | 182/186.6 |
| 5,860,489 | A | * | 1/1999 | Krause | 182/17 |
| 6,443,262 | B1 | * | 9/2002 | Karanouh | 182/178.1 |
| 6,585,083 | B2 | * | 7/2003 | Santarlasci | 182/118 |
| 6,651,775 | B2 | * | 11/2003 | Bassett, Jr. | 182/69.5 |
| 6,786,301 | B2 | | 9/2004 | Nesburg et al. | |
| 6,827,181 | B2 | | 12/2004 | Austin et al. | |
| 6,959,785 | B1 | | 11/2005 | Chilton | |
| 2003/0061779 | A1 | * | 4/2003 | Wyse | 52/651.1 |
| 2009/0050405 | A1 | * | 2/2009 | Oost | 182/82 |
| 2010/0096216 | A1 | | 4/2010 | Csaszar et al. | |

* cited by examiner

*Primary Examiner* — Katherine Mitchell
*Assistant Examiner* — Candace L Bradford
(74) *Attorney, Agent, or Firm* — Jason H. Foster; Kremblas & Foster

(57) ABSTRACT

An adjustable scaffold base for straddling ground level obstructions, such as church pews and other fixed, ground level structures, and supporting an upwardly-extending scaffold tower thereon. The scaffold base incorporates four legs and four elevated, height-adjustable cross beams that allow a scaffold tower to be erected above the height of many fixed, ground level structures. The erected base and tower thereby allow workers to access elevated areas within high-ceilinged buildings, such for performing ceiling repairs, painting, and changing light bulbs.

24 Claims, 10 Drawing Sheets

ADJUSTABLE SCAFFOLD BASE

CROSS-REFERENCES TO RELATED APPLICATIONS

This application claims the benefit of U.S. Provisional Application No. 61/351,320 filed Jun. 4, 2010.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

This invention relates generally to the field of scaffolding and more particularly to an adjustable scaffold base for allowing scaffold towers to be erected above ground level obstructions.

Traditionally, it has generally been difficult to change light bulbs or perform other high-elevation indoor maintenance tasks, such as painting or repairing ceiling surfaces, in churches, theaters, stadiums or other buildings that have high ceilings and that also have permanently-fixed ground level obstructions, such as pews or other fixed seating structures. Traditional frame-scaffolding that would normally be erected to facilitate high-elevation maintenance tasks is generally inappropriate for environments that include ground level obstructions because the spacing between the frame legs of such scaffolding typically does not match the spacing around pews or other large or irregularly-shaped obstructions. Even if the frame spacing of traditional scaffolding could be made to coincide with the spacing around ground level obstructions, the necessary cross-bracing between the scaffold frames would hit the obstructions. Furthermore, the legs supporting the scaffolding may have to bear on surfaces that can be 45 inches or more out of level with one another, whereas typical scaffolding leveling jacks that are normally employed to accommodate uneven surfaces only have about 14 inches of vertical adjustment. Still further, typical scaffold frames are only wide enough to support freestanding structures that are approximately 20 feet tall, which is not tall enough to reach the ceilings of many buildings.

It is possible for scaffold companies to build tube-and-clamp scaffolding structures that accommodate environments that present immovable, ground level obstructions, but the cost of labor and equipment to erect such structures is often prohibitively expensive. It would therefore be desirable to provide a relatively low-cost, highly adjustable scaffolding system that can be erected around immovable, ground level obstructions for accommodating high-elevation tasks such as replacing light bulbs and painting or repairing ceiling surfaces.

It is therefore an object and feature of the present invention to provide a low-cost means for allowing a conventional scaffold tower to be erected in a manner that avoids ground level obstructions. It is a further object and feature of the present invention to provide such a means that is suitable for supporting a conventional scaffold tower having a height that is sufficient for allowing a worker to reach the ceiling of a church or other such building having high ceilings. It is a further object and feature of the present invention to provide such a means that can be easily moved while still fully erected.

BRIEF SUMMARY OF THE INVENTION

In accordance with the present invention, there is provided an adjustable scaffold base for supporting a conventional scaffold tower at an elevated position above ground level obstructions. The scaffold base includes four elongated, upstanding primary legs that are spaced apart in a parallel relationship with one another. A first lateral beam extends between two of the primary legs in a perpendicular relationship therewith, and a second lateral beam extends between the other two of the primary legs in a perpendicular relationship therewith and in a parallel relationship with the other lateral beam. Each primary leg extends through a primary leg sleeve that is rigidly affixed to an adjacent end of the primary leg's respective lateral beam. Each primary leg sleeve can slidably move along its respective primary leg, thereby allowing each lateral beam to move up and down along the length of its respective pair of primary legs. Each primary leg sleeve can be removably secured at a plurality of positions along the length of its respective primary leg by extending a pin through a pair of axially-aligned positioning holes formed in the primary leg and its respective primary leg sleeve.

First and second frame beams extend across, and are removably secured to, the first and second lateral beams in a perpendicular relationship therewith and in a spaced, parallel relationship with one another. Each frame beam can be removably secured at a plurality of positions along the length of each lateral beam. A pair of frame posts extends upwardly from each of the frame beams in a perpendicular relationship therewith and in a spaced relationship with one another for engaging and rigidly supporting the scaffold frames of a conventional scaffold tower. A scaffold tower can thus be erected and supported atop the scaffold base, with the scaffold base straddling and avoiding ground level obstructions, such as church pews or other fixed, ground level structures.

The erected scaffold base and scaffold tower can be easily moved by inserting four auxiliary legs into vertically-oriented auxiliary leg sleeves that are rigidly affixed to the ends of the frame beams. Conventional casters are mounted to the bottom ends of the auxiliary legs. All of the auxiliary legs are lowered within their respective auxiliary leg sleeves until their casters are in contact with the surface upon which the scaffold base stands. The positions of the auxiliary legs are then secured by inserting pins through aligned pairs of positioning holes in the auxiliary leg sleeves and the auxiliary legs. Each of the primary legs is then raised within its primary leg sleeve and is secured at an elevated position, thereby leaving the scaffold base and the scaffold tower supported solely by the auxiliary legs and casters. The scaffold base can then be rolled upon the casters to a desired location, after which the primary legs can again be lowered and secured.

Figure 1A:
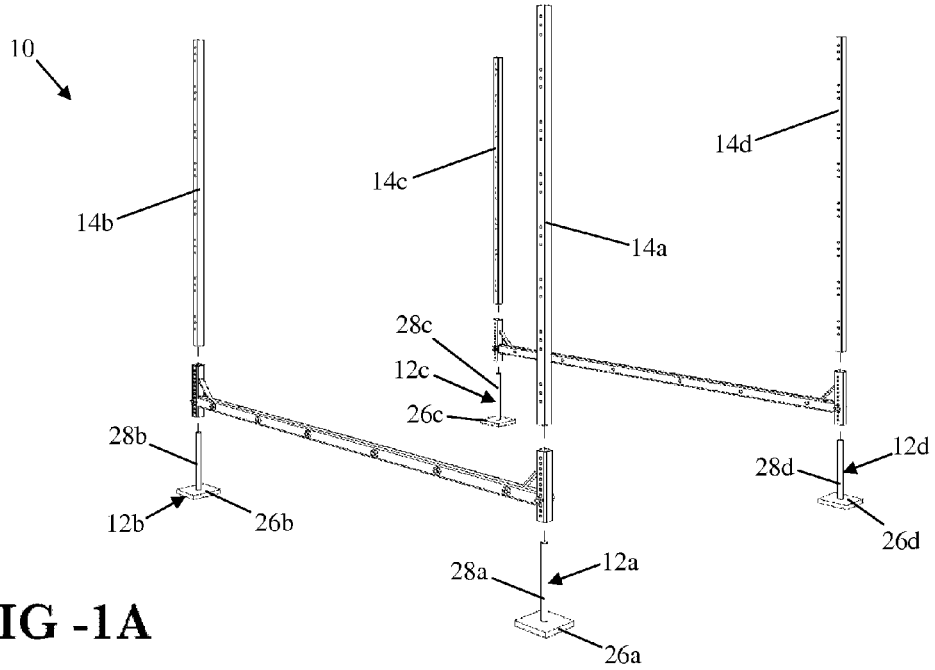
FIG. 1*a* is an exploded, perspective view illustrating the legs, feet, and lateral beams of the scaffold base present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

This application claims the benefit of U.S. Provisional Application No. 61/351,320, which is incorporated herein by reference.

Referring to FIGS. 1*a*-4*b*, an adjustable scaffold base for straddling ground level obstructions, such as church pews and other fixed structures, and supporting an upwardly-extending scaffold tower is indicated generally at 10. The scaffold base 10 is defined by four feet 12*a-d*, four primary legs 14*a-d*, two lateral beams 16 and 18, two frame beams 20 and 22, and a cross brace 24. Unless otherwise noted below, all of the components of the scaffold base 10 are fabricated from steel members and preferably square steel tubing members in particular. The use of any other suitable material, or combination of materials, such as aluminum, plastic and various composites, is contemplated and will be understood by the person having ordinary skill.

Figure 3A:
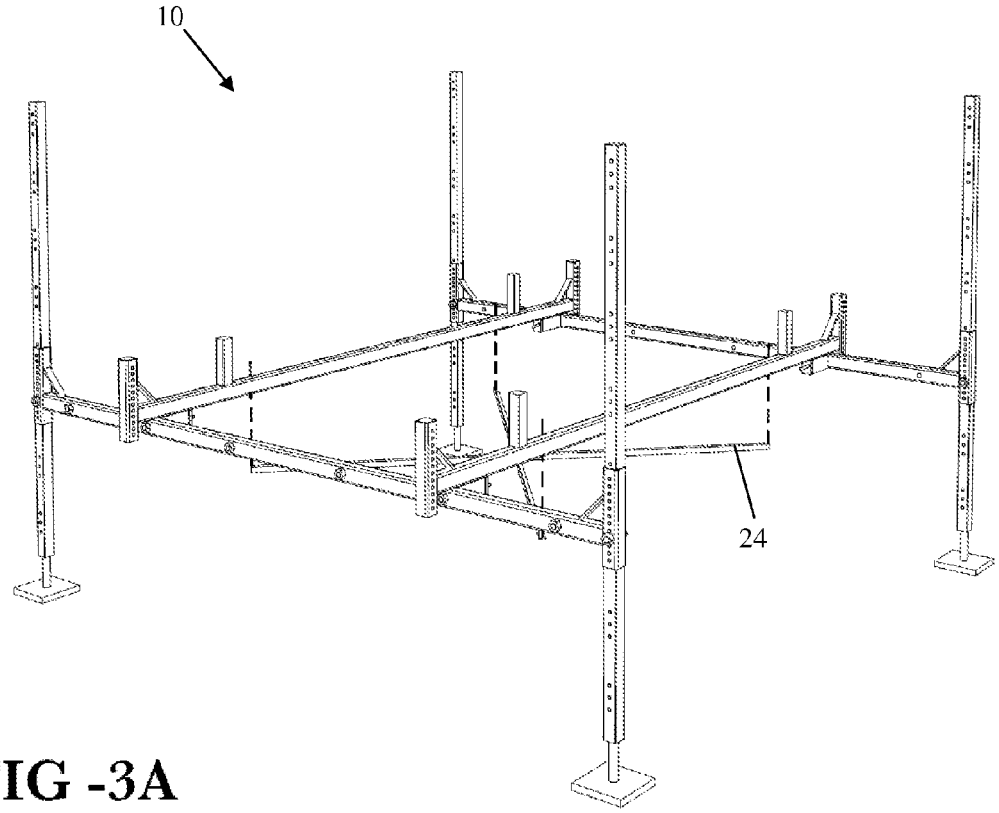
FIG. 3*a* is a partially exploded perspective view illustrating the legs, feet, lateral beams, frame beams, and cross brace of the present invention.
Figure 3B:
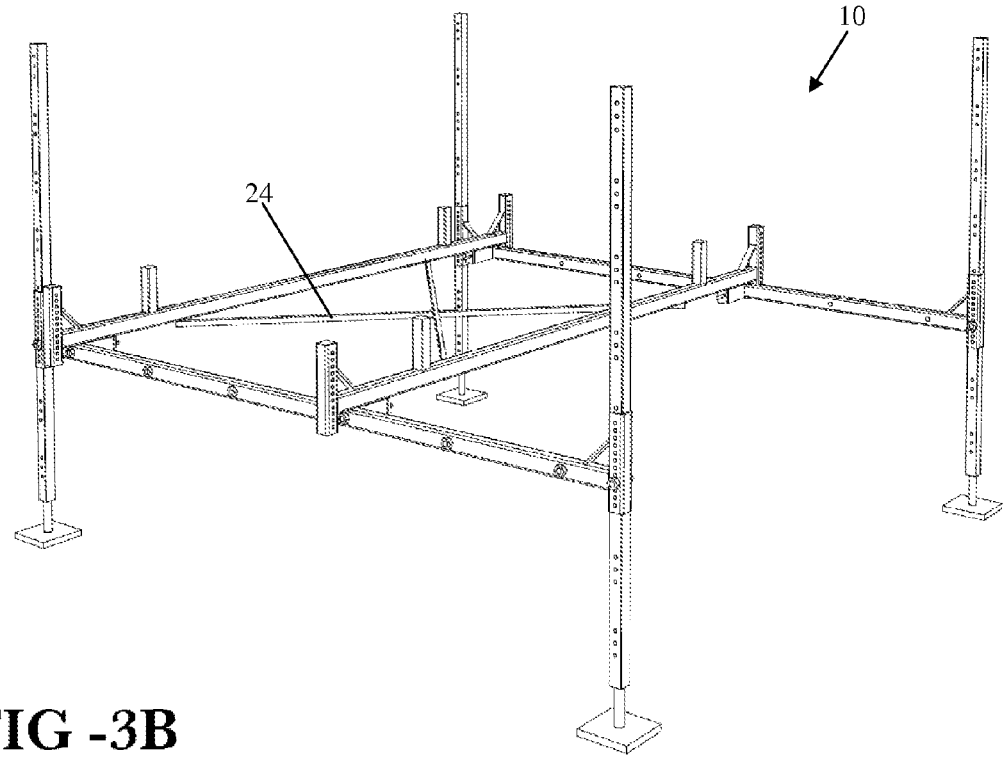
FIG. 3*b* is a perspective view illustrating the fully assembled scaffold base of the present invention.

For the sake of convenience and clarity, terms such as "top," "bottom," "up," "down," "inwardly," "outwardly," "lateral," and "longitudinal" will be used herein to describe the relative placement and orientation of various components of the invention, all with respect to the geometry and orientation of the fully assembled scaffold base 10 as it appears in FIG. 3*b*.

Referring to FIG. 1*a*, each foot 12*a-d* of the scaffold base is defined by a planar, preferably rectangular base plate 26*a-d*, such as may be formed from wood or steel, with a tubular neck 28*a-d* formed of a segment of round steel tubing rigidly affixed thereto in a perpendicular relationship therewith. Each foot 12*a-d* is positioned on a support surface, such as the floor of a building, with the bottom of each base plate 26*a-d* engaging the support surface and with the tubular neck 28*a-d* of each foot 12*a-d* extending upwardly therefrom. The support surface is typically an indoor flooring surface such as stone, brick, tile, or carpet, but could alternatively be soil, pavement or other outdoor surfaces. Of course, the flat base plates 26*a-d* can be replaced by wheels or narrow legs.

Figure 1B:
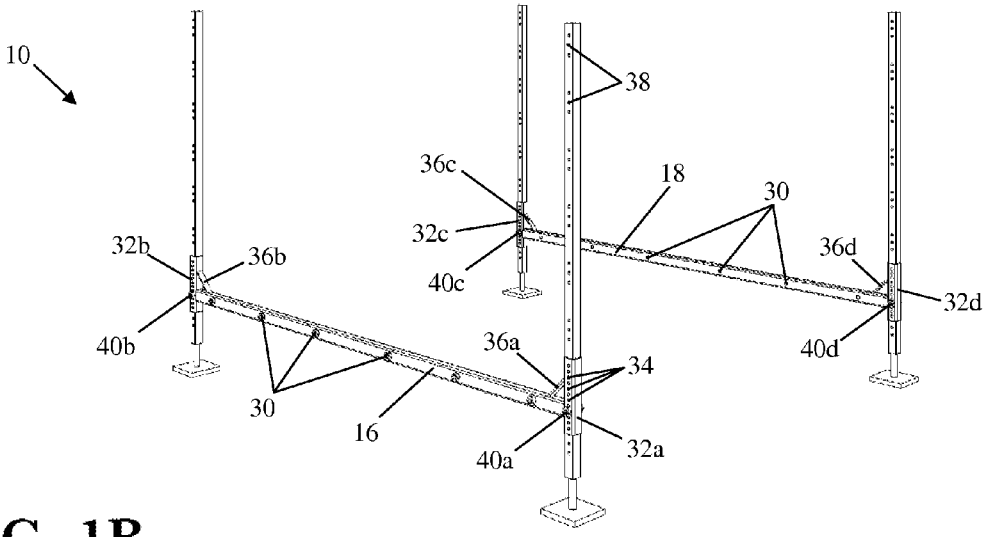
FIG. 1*b* is a perspective view illustrating the assembled legs, feet, and lateral beams of the scaffold base of the present invention.

Referring to FIG. 1*b*, each lateral beam 16 and 18 of the scaffold base 10 is formed of an elongated segment of rectangular steel tubing that is preferably 7 feet, 9 inches in length, although it is contemplated that the lateral beams 16 and 18 can be made shorter or longer to suit various applications. Each lateral beam 16 and 18 has a series of positioning holes 30 formed through it that are spaced on 16 inch centers, wherein each positioning hole 30 provides a transverse, lateral passageway through its respective lateral beam 16 and 18. An example of an acceptable diameter for each positioning hole 30 in the lateral beams 16 and 18 is 0.625 inches. The term "hole" is often used hereinafter to refer to a pair of axially aligned apertures, wherein one of the apertures is positioned on one sidewall of a hollow body, such as a tube, and the other aperture is positioned on the opposing sidewall. Each "hole" thereby provides a single passageway through the entire body, even though only one of the apertures of the hole is depicted in the illustrations. For example, only one of the apertures in each hole-pair is depicted in FIGS. 1*a* and 1*b*. The other apertures are on the opposite side of the structures but are impossible to show in an illustration of a three dimensional object.

Each lateral beam 16 and 18 terminates at each of its longitudinal ends in a primary leg sleeve 32*a-d* that is formed of a short segment of square steel tubing that is rigidly connected to its respective lateral beam 16 and 18, such as by welds, in a perpendicular relationship therewith. Each primary leg sleeve 32*a-d* has positioning holes 34 formed through it that are spaced on 1.25 inch centers along the sleeve's length. Flat steel segments 36*a-d* are preferably welded to the primary leg sleeves 32*a-d* and to their respective lateral beams 16 and 18 for enhancing the strength and rigidity of the connections between the primary leg sleeves 32*a-d* and the lateral beams 16 and 18. Although incorporation of the leg sleeves 32*a-d* is preferred, it is contemplated that the leg sleeves 32*a-d* can be omitted and that the vertically-oriented holes can alternatively be formed through the lateral beams 16 and 18 for accepting the primary legs 14*a-d* (as described below).

Referring to FIG. 1*a*, each of the primary legs 14*a-d* of the scaffold base 10 is formed of an elongated segment of square steel tubing that preferably measures 5 feet in length. It is contemplated that the primary legs 14*a-d* can be made shorter or longer than 5 feet, and that one or more of the primary legs 14*a-d* can have a length that is different than one or more of the other primary legs 14*a-d*. Each primary leg 14*a-d* has a series of groups of three positioning holes 38 formed through it, with the positioning holes 38 in each group being spaced on 2 inch centers and with each group spaced 8 inches apart, thus allowing ½ inch vertical adjustment of the primary legs 14*a-d*. Referring to FIG. 1*b*, each primary leg 14*a-d* extends through, and axially engages, a primary leg sleeve 32*a-d* of one of the lateral beams 16 and 18 (described above), with two of the primary legs 14*a-d* thus mounted to each lateral beam 16 and 18 in a parallel relationship and at a fixed distance apart from one another. The exterior dimensions of the primary legs 14*a-d* are slightly smaller than the interior dimensions of the primary leg sleeves 32*a-d* in order that the primary leg sleeves 32*a-d* may snugly receive the primary legs 14*a-d* while allowing sliding axial movement of the primary leg sleeves 32*a-d*, and therefore the lateral beams 16 and 18, relative to the primary legs 14*a-d*. Threaded stability bolts (not shown) preferably extend horizontally through a corner of each primary leg sleeve 32*a-d* with the flats tips of the bolts engaging the primary legs 14*a-d* within the sleeves. By tightening the bolts against the primary legs 14*a-d* the primary legs 14*a-d* can be stabilized against excessive lateral movement within their respective primary leg sleeves 32*a-d*.

The bottommost ends of the primary legs 14*a-d* fit over and axially engage the necks 28*a-d* of the feet 12*a-d*, thereby rigidly supporting the primary legs 14*a-d* in a vertical orientation. Alternative embodiments of the scaffold base 10 are contemplated in which the primary legs 14*a-d* are permanently mounted to the lateral beams 16 and 18 in a fixed position and are not slideably adjustable relative thereto.

In order to adjust the heights of the lateral beams 16 and 18, such as to a height above fixed, ground level obstructions (described in greater detail below), the primary leg sleeves 32*a-d* of each lateral beam 16 and 18 can be slid upwardly or downwardly along their respective primary legs 14*a-d*. Since each lateral beam 16 and 18 is fixed at both of its longitudinal ends to a respective, vertically-oriented primary leg 14*a-d* in a substantially perpendicular orientation therewith, the lateral beams 16 and 18 will remain in a substantially horizontal orientation as they are moved vertically along their respective primary leg-pairs. After each lateral beam 16 and 18 has been moved to a desired height at least one of the positioning holes 34 in each primary leg sleeve 32*a-d* is brought into axial alignment with a closest positioning hole 38 in a respective primary leg 14*a-d*. Pins 40*a-d* are then inserted through each pair of aligned positioning holes 34 and 38 to secure the primary leg sleeves 32*a-d* against vertical movement along the primary legs 14*a-d*, thereby fixing the lateral beams 16 and 18 at the desired height. The pins 40*a-d* are preferably standard, spring-loaded, positive locking pins having an outer diameter that is slightly smaller than the diameter of the respective holes through which they pass. However, all other types of fastening means, such as screws, bolts, rivets, clamps, non-spring-loaded pins, and friction mounts are also contemplated.

Figure 2A:
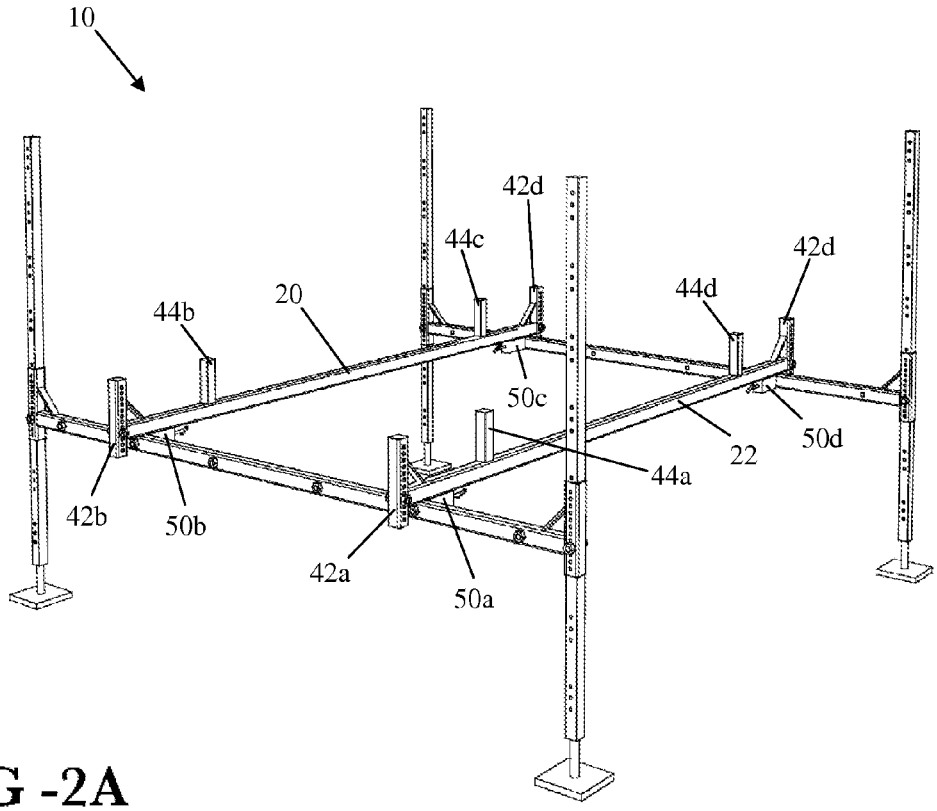
FIG. 2*a* is a perspective view illustrating the assembled legs, feet, lateral beams, and frame beams of the scaffold base of the present invention.

Referring to FIG. 2*a*, the frame beams 20 and 22 are similar in construction and size to the lateral beams 16 and 18, including auxiliary leg sleeves 42*a-d* mounted to the longitudinal ends of the frame beams 20 and 22 that are substantially identical to the primary leg sleeves 32*a-d* described above. Unlike the lateral beams 16 and 18, the frame beams 20 and 22 do not have positioning holes formed in them. Each frame beam 20 and 22 includes a pair of frame posts 44*a-d* formed of short segments of square steel tubing that are rigidly mounted to, and that extend upwardly from, the frame beams' top surfaces. The frame posts 44*a-d* on each frame beam 20 and 22 are preferably spaced 5 feet apart from one another and are equidistant from the nearest longitudinal ends of their respective frame beam 20 and 22, although it is contemplated that this spacing can be varied from the preferred distances.

Figure 2B:
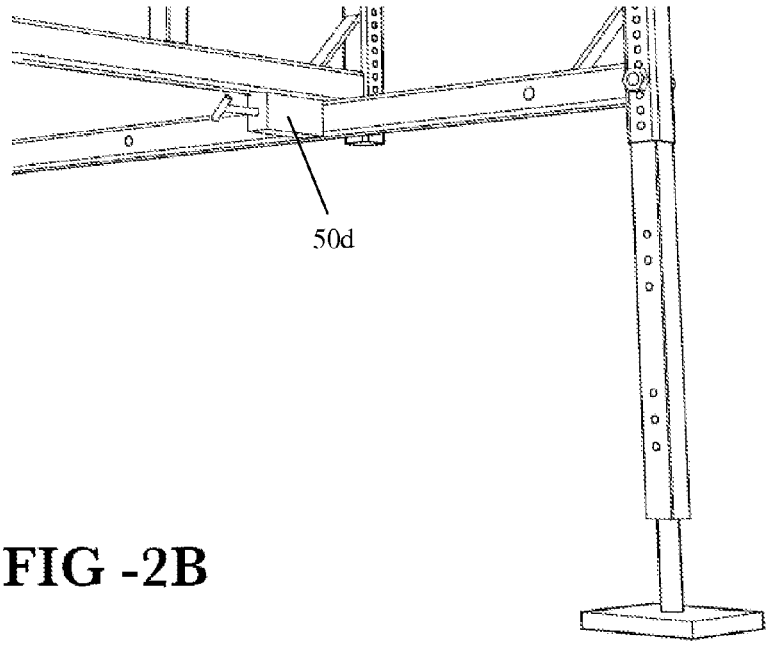
FIG. 2*b* is a detail view illustrating the mounting bracket of a frame beam of the present invention.

A pair of positioning brackets 50*a-d* is rigidly mounted to the underside of each frame beam 20 and 22, with each positioning bracket 50*a-d* positioned about 4.5 inches inward from a nearest longitudinal end of the frame beam 20 and 22. The positioning brackets 50*a-d* preferably measure 6 inches long and are formed of rectangular blocks of steel. Each positioning bracket 50*a-d* has a 0.625 inch diameter positioning hole (not within view) extending horizontally through it for receiving a threaded bolt of a slightly smaller diameter (as described below), as best shown in FIG. 2*b*.

Figure 4A:
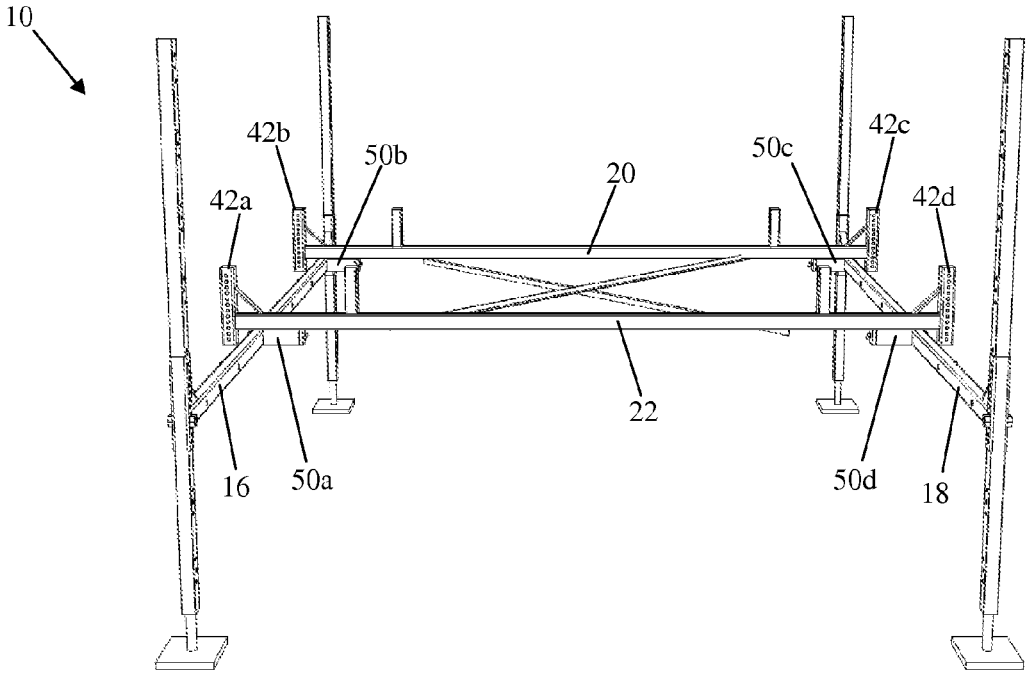
FIG. 4*a* is a front view illustrating the scaffold base of the present invention with the lateral beams mounted to the outsides of the mounting brackets of the frame beams.
Figure 4B:
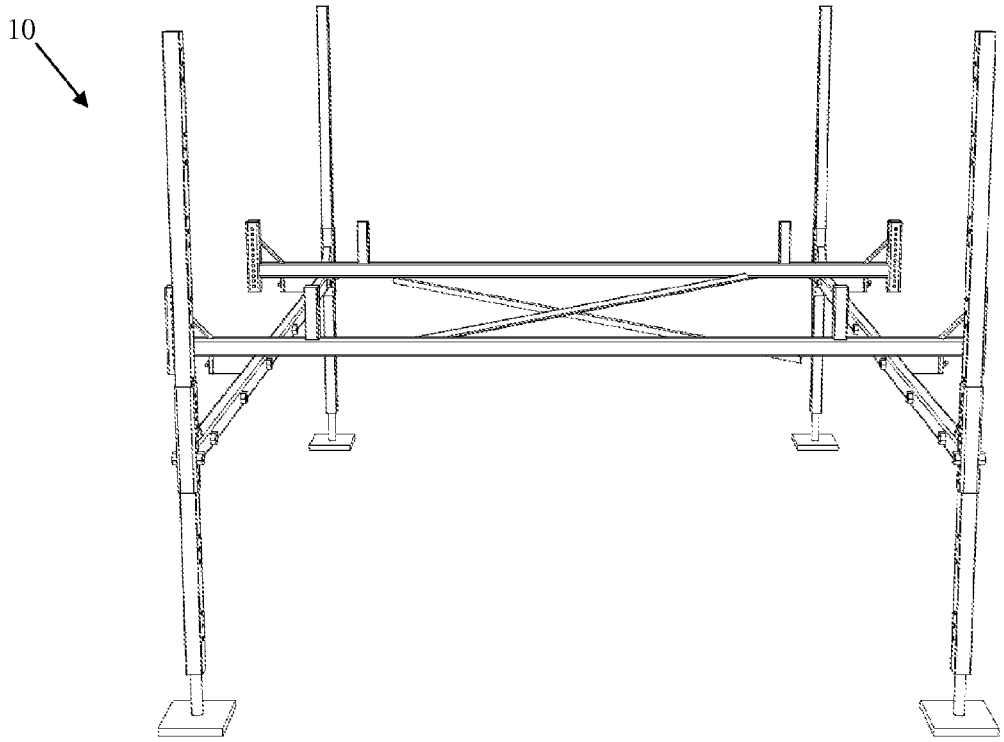
FIG. 4*b* is a front view illustrating the scaffold base of the present invention with the lateral beams mounted to the insides of the mounting brackets of the frame beams.

When operatively positioned, the frame beams 20 and 22 rest on top of, and extend perpendicularly across, the lateral beams 16 and 18, with each lateral beam 16 and 18 positioned inward of the auxiliary leg sleeves 42*a-d* and outward of the positioning brackets 50*a-d* of the frame beams 20 and 22 as best shown in FIGS. 2*a* and 4*a*. The frame beams 20 and 22 are preferably spaced 4 feet apart in a parallel relationship with one another, and with the positioning holes in the positioning brackets 50*a-d* aligned with corresponding positioning holes 30 in the lateral beams 16 and 18. Threaded bolts extend outwardly, through the positioning holes in the positioning brackets 50*a-d* and through the positioning holes 30 in the lateral beams 16 and 18. Nuts threadedly engage the outermost ends of the bolts, thereby securing the frame beams 20 and 22 to the lateral beams 16 and 18. Configured thusly, the lateral beams 16 and 18 are spaced 7 feet apart. Alternatively, if the spacing between the lateral beams 16 and 18 must be less than 7 feet, such as for adjusting the spacing between the primary legs 14*a-d* to avoid ground level obstructions, the lateral beams 16 and 18 can be secured to the innermost sides of the positioning brackets, as shown in FIG. 4*b*. The threaded bolts extend inwardly through the positioning brackets 50*a-d* and the lateral beams 16 and 18 and with the nuts engaging the innermost ends of the bolts, in which case the lateral beams 16 and 18 are spaced 6 feet apart. It is also possible to secure one of the lateral beams 16 and 18 to the outermost side of its corresponding positioning brackets 50*a-d* and secure the other lateral beam 16 and 18 to the innermost side of its positioning brackets 50*a-d*, in which case the lateral beams 16 and 18 are spaced 6 feet 6 inches apart. Alternative embodiments of the scaffold base are contemplated wherein the positioning brackets 50*a-d* are omitted and the frame beams 20 and 22 are rigidly connected to the lateral beams 16 and 18 in a fixed position, such as by welds or conventional fasteners.

Referring to FIGS. 3*a* and 3*b*, the cross brace 24 is formed of two elongated segments of steel angle that are fastened together in a perpendicular relationship, such as with a rivet, to form an X-shaped member. The cross brace spans across, and is rigidly fastened to, the undersides of the frame beams 20 and 22, such as with conventional nut-bolt combinations that engage apertures formed through the cross brace 24 and the frame beams 20 and 22, for providing the scaffold base 10 with added strength and rigidity. It is contemplated that the cross brace 24 can be rigidly fastened to the frame beams 20 and 22 in any other suitable manner. It is further contemplated that the cross brace 24 can be omitted or that other bracing means, such as additional lateral or longitudinal frame members installed intermediate the frame beams 20 and 22 and the lateral beams 16 and 18, can additionally or alternatively be incorporated into the scaffold base 10.

Figure 5:
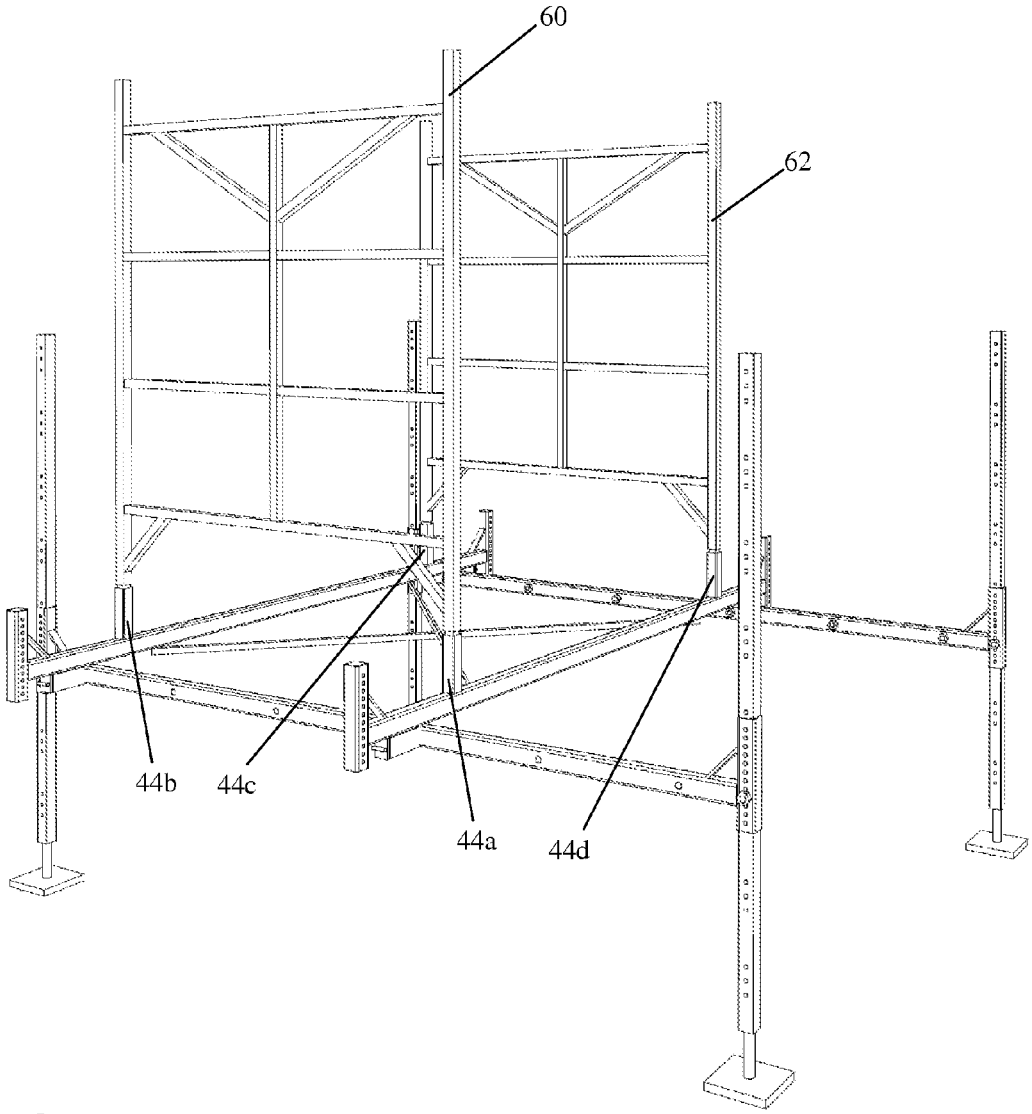
FIG. 5 is a perspective view illustrating a pair of scaffold frames mounted to the scaffold base of the present invention.
Figure 6:
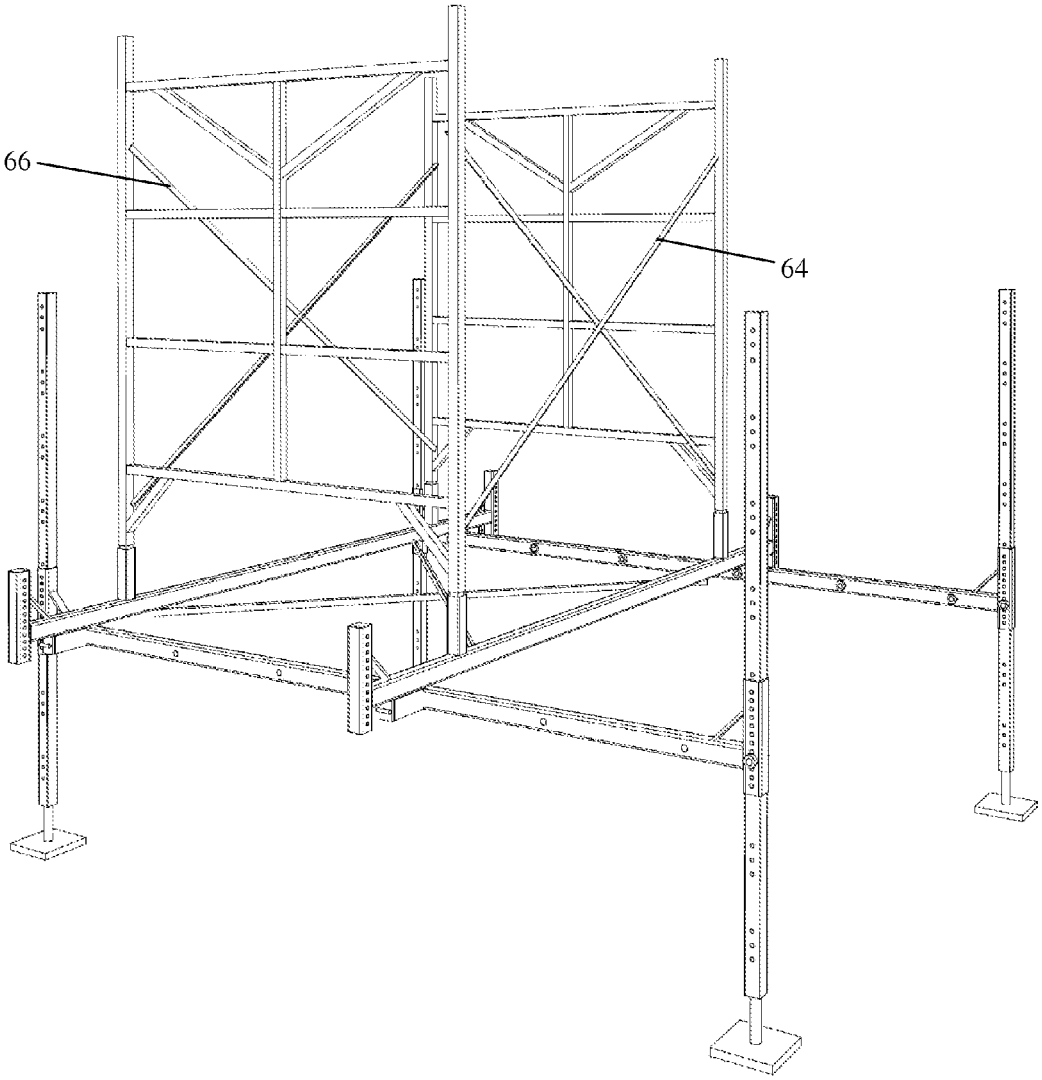
FIG. 6 is a perspective view illustrating a pair of cross braces mounted to the scaffold frames shown in FIG. 5.
Figure 7:
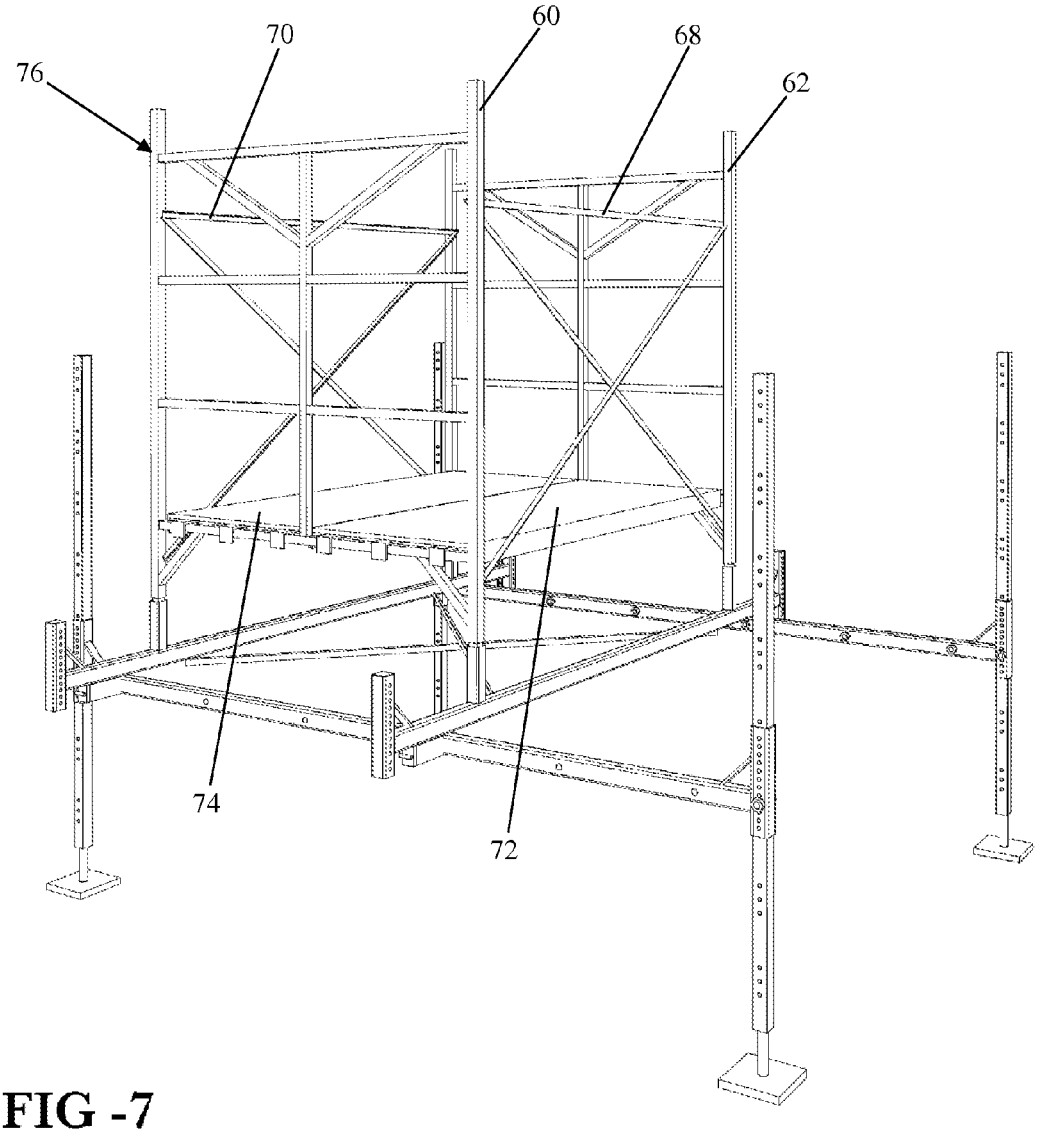
FIG. 7 is a perspective view illustrating a pair of guard rails and work platforms mounted to the scaffold frames shown in FIG. 6.
Figure 8:
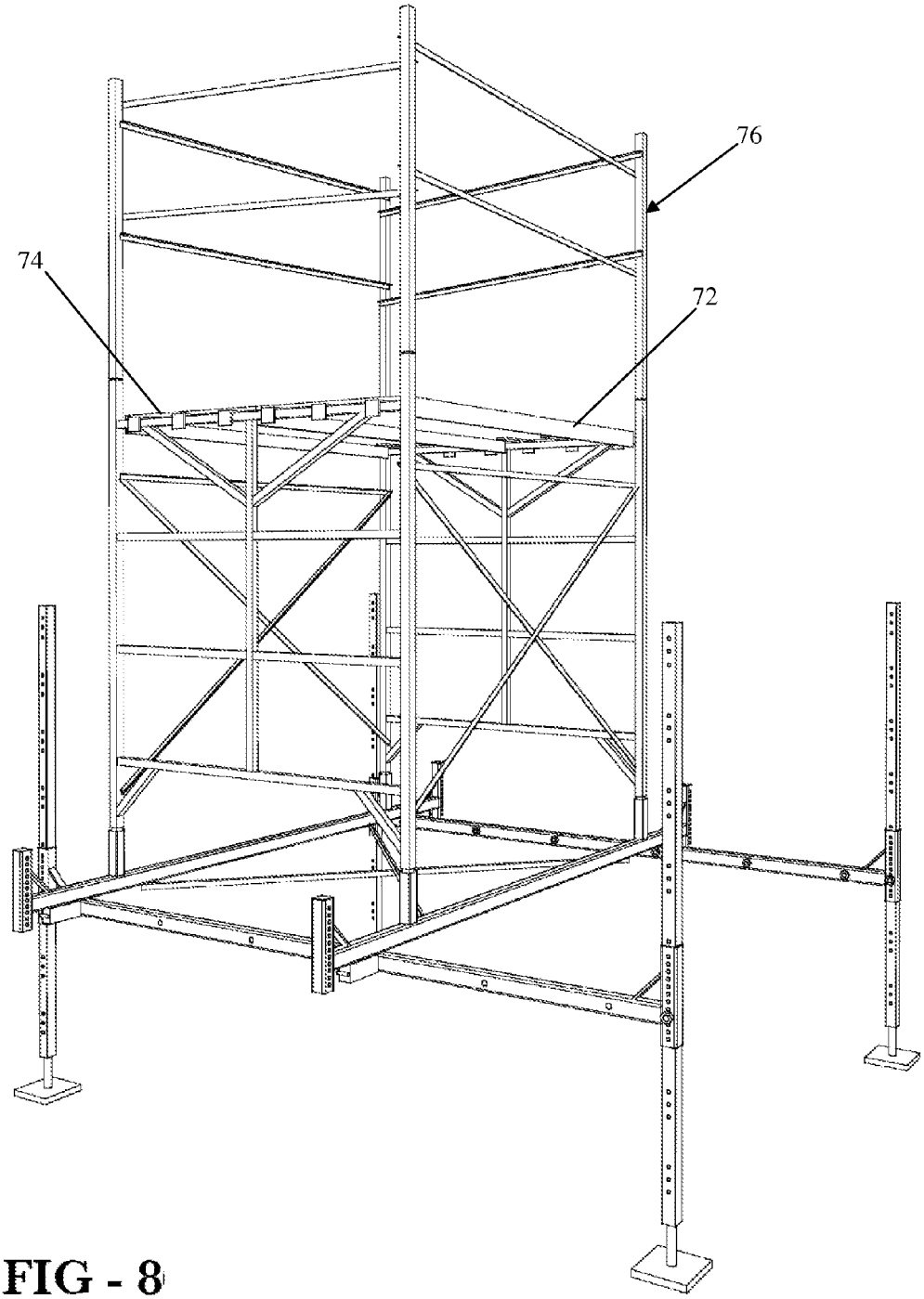
FIG. 8 is a perspective view illustrating guardrail posts mounted to the scaffold frames shown in FIG. 7.

Referring to FIG. 5, once the scaffold base 10 has been erected at a desired location and the lateral beams 16 and 18 have been adjusted to a desired height, such as above the height of ground level obstructions that would prevent the erection of traditional scaffold towers, conventional scaffold frames 60 and 62 can be connected to the elevated frame beams 20 and 22. Particularly, elongated stack pins (not shown) that extend from, and are rigidly connected to, the uppermost ends of the vertical members of the scaffold frames 60 and 62 axially engage the frame posts 44*a-d* and are securely held therein in a vertical orientation. The scaffold frames 60 and 62 thereby span across the frame beams 20 and 22 and are secured in a vertical orientation and in a parallel relationship with one another. Referring to FIG. 6, the scaffold frames 60 and 62 are preferably secured to one another with conventional cross braces 64 and 66. Finally, referring to FIG. 7, conventional guardrails 68 and 70 and aluminum work platforms 72 and 74 are secured to the scaffold frames 60 and 62 to complete the scaffold tower 76. If more height is required, additional frame members and guardrails can be added to the scaffold frames 60 and 62 in a conventional manner and the work platforms 72 and 74 can be secured at a higher position on the scaffold tower 76, as shown in FIG. 8. During testing it has been demonstrated that the scaffold base 10 is capable of stably supporting free-standing scaffold structures measuring over 150 feet in overall height.

Figure 9:
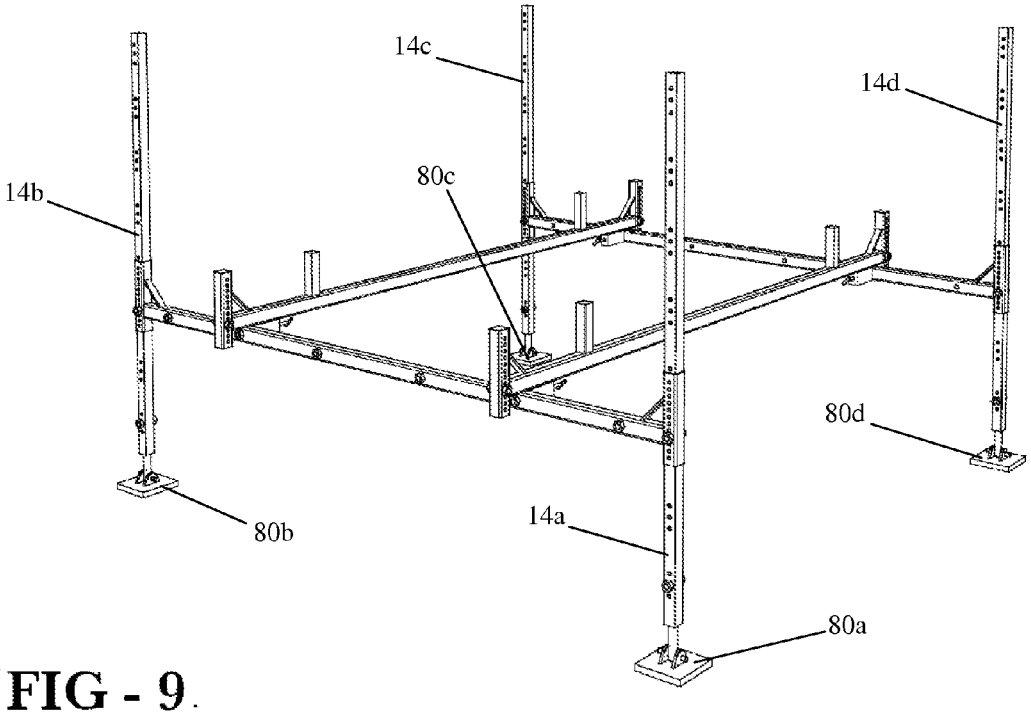
FIG. 9 is a perspective view illustrating the scaffold base of the present invention with swivel plates mounted to the legs.
Figure 10:
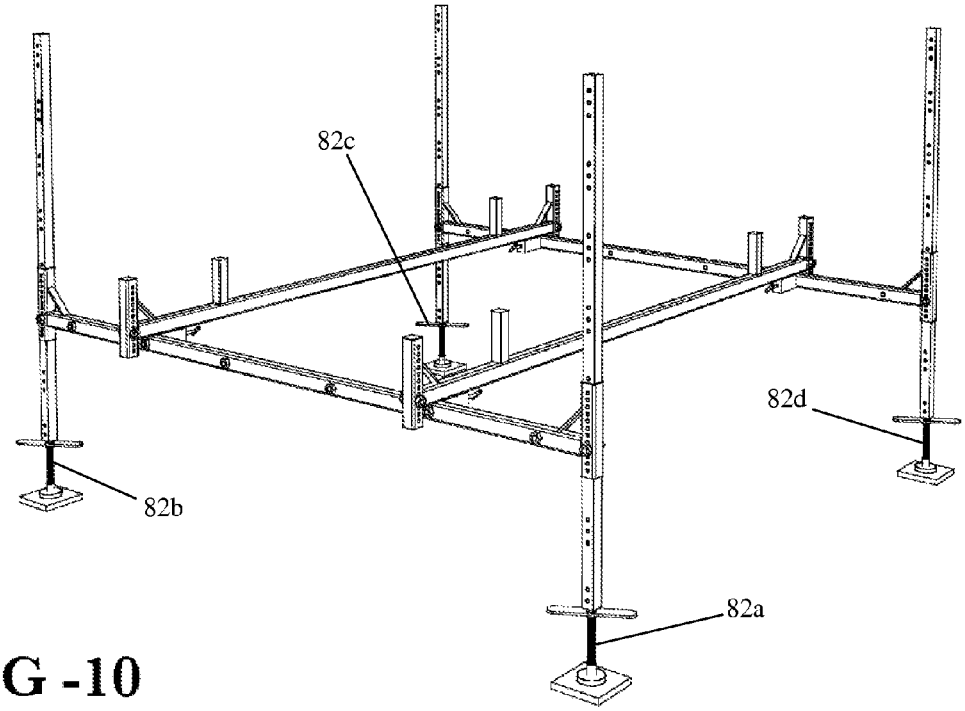
FIG. 10 is a perspective view illustrating the scaffold base of the present invention with leveling jacks mounted to the legs.

If the scaffold base 10 must be positioned on a sloped surface, such as on an auditorium aisle way or on a wheelchair ramp, it is contemplated that conventional swivel plates 80*a-d* can be substituted for one or more of the feet 12*a-d*, as shown in FIG. 9, for allowing the primary legs 14*a-d* to extend vertically from the sloped surface. It is further contemplated that one or more of feet 12*a-d* can be replaced by screw-threaded leveling jacks 82*a-d*, as shown in FIG. 10, for allowing the heights of the primary legs 14*a-d* to be finely adjusted and leveled to optimize the stability of a scaffold tower erected thereon. Those skilled in the art will recognize that various other mounting accessories can be substituted for one or more of the feet 12*a-d* without departing from the spirit of the invention.

Figure 11:
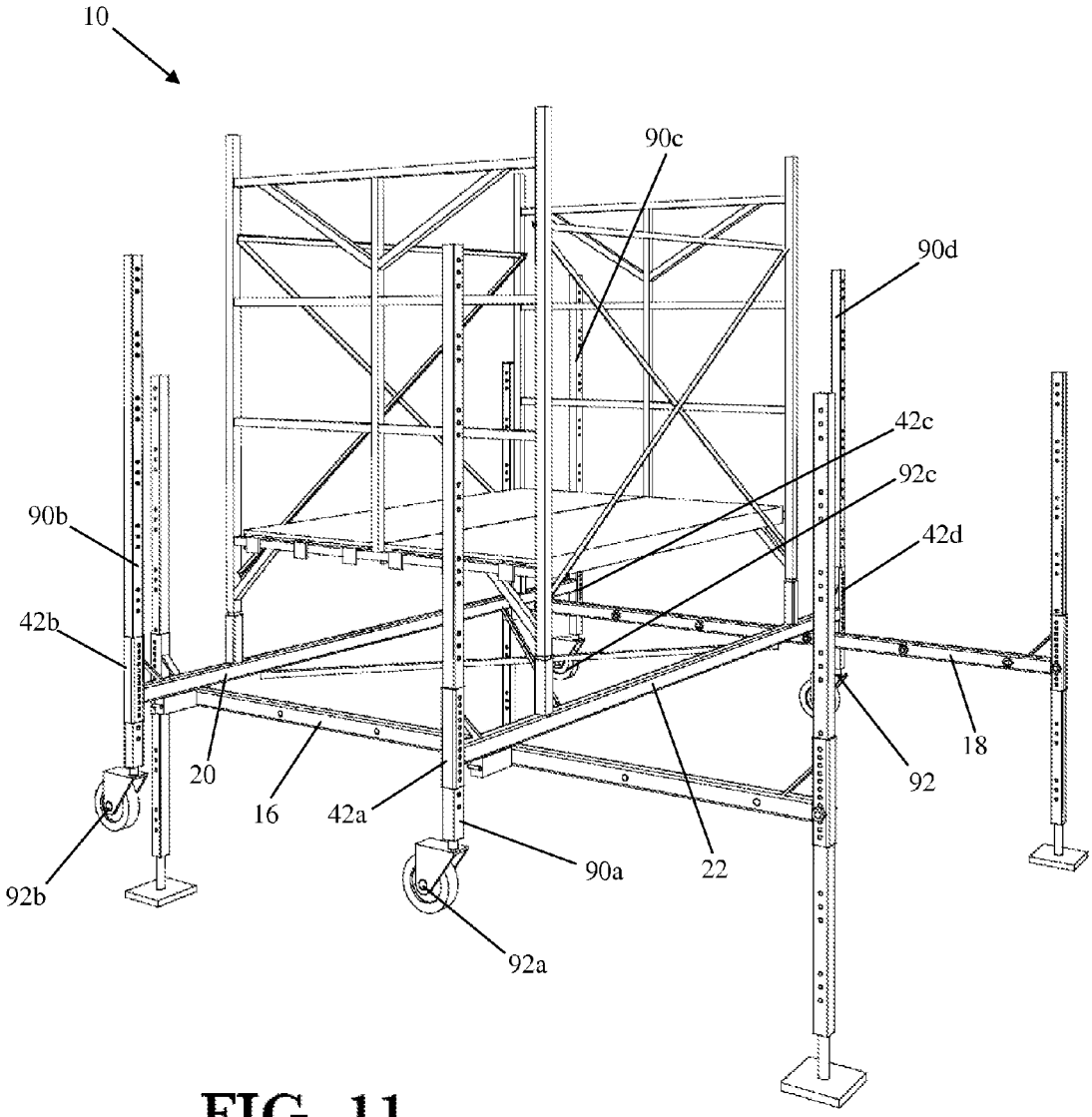
FIG. 11 is a perspective view illustrating the scaffold base of the present invention with auxiliary legs having casters mounted to the frame beams.

Referring to FIG. 11, the erected scaffold base 10 and tower can be conveniently moved through the use of auxiliary legs 90*a-d* that are fitted with casters 92*a-d*. This is accomplished by inserting the auxiliary legs 90*a-d* into the auxiliary leg sleeves 42*a-d* (described above) of the frame beams 20 and 22 from above, after which conventional scaffold casters 92*a-d* are mounted to the bottom ends of the auxiliary legs 90*a-d*. The auxiliary legs 90*a-d* engage the auxiliary leg sleeves 42*a-d* of the frame beams 20 and 22 in a substantially identical manner to the engagement between the primary legs 14*a-d* and the primary leg sleeves 32*a-d* of the lateral beams 16 and 18 described above. The height of each auxiliary leg 90*a-d* relative to its respective auxiliary leg sleeve 42*a-d* can similarly be adjusted and secured by sliding the auxiliary legs 90*a-d* vertically within their respective auxiliary leg sleeves 42*a-d* to a desired height and inserting pins through aligned pairs of positioning holes in the auxiliary leg sleeves 42*a-d* and the auxiliary legs 90*a-d*. It is contemplated that the primary legs 14*a-d* can also be fitted with castors for further improving the mobility of the scaffold base 10.

To move the scaffold base 10, all of the auxiliary legs 90*a-d* are lowered until their respective casters 92*a-d* are in contact with, or are nearly in contact with, the surface upon which the feet 12*a-d* of the scaffold base 10 rest. The vertical positions of the auxiliary legs 90*a-d* are then secured. Each of the primary legs 14*a-d* is then raised within its primary leg sleeve 32*a-d* and is secured at an elevated position, thereby leaving the scaffold base 10 and the scaffold tower supported solely by the auxiliary legs 90*a-d* and casters 92*a-d*. Alternatively, the primary legs 14*a-d* can be entirely removed from their respective primary leg sleeves 32*a-d* (which requires removal of the feet after the primary legs 14*a-d* have been raised a short distance off the support surface). The scaffold base 10 can then be rolled upon the casters 92*a-d* to a desired location. Since the auxiliary legs 90*a-d* are spaced only four feet apart from one another, the scaffold base 10 can easily fit through most aisle ways and other narrow areas while the elevated lateral beams 16 and 18 and primary leg sleeves 32*a-d* move above ground level obstructions (i.e., if the primary legs 14*a-d* have been entirely removed from, or sufficiently raised in, the scaffold base 10). Once the scaffold base 10 has been moved to a desired location, the primary legs 14*a-d* and feet can be reinstalled and repositioned to support the scaffold base 10 in the manner described above, and the auxiliary legs 90*a-d* and casters 92*a-d* can be raised or entirely removed from the scaffold base 10.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An adjustable scaffold base supporting a scaffold tower formed of scaffold frames in an elevated position above a support surface, the scaffold tower having at least four downwardly extending, spaced scaffold tower legs, the scaffold base comprising:

(a) first, second, third and fourth elongated, upstanding primary legs in a substantially parallel, spaced relationship with one another, the lower end of each primary leg having an engaging component seating against the support surface;

(b) a first lateral beam extending substantially perpendicularly between the first and second primary legs and a second, spaced lateral beam extending substantially perpendicularly between the third and fourth primary legs, each of the primary legs extending through one of four respective substantially parallel primary leg sleeves rigidly affixed to ends of the corresponding lateral beams, whereby each primary leg sleeve slideably surrounds its respective primary leg to permit each lateral beam to move along the length of its respective primary legs except when each primary leg sleeve is removably secured at one of a plurality of positions along the length of its respective primary leg;

(c) first and second spaced frame beams extending transversely across, and removably secured between the primary leg sleeves to, the first and second lateral beams;

(d) auxiliary leg sleeves rigidly affixed, and substantially perpendicular, to ends of the corresponding frame beams and substantially parallel to the primary leg sleeves;

(e) elongated auxiliary legs extending through a respective one of the auxiliary leg sleeves, a lowermost end of each auxiliary leg terminating in a component for engaging the support surface, wherein each auxiliary leg is slidably mounted within its respective auxiliary leg sleeve; and (f) a pair of spaced frame posts extending transversely from each frame beam between the auxiliary leg sleeves and the primary leg sleeves and engaging and supporting the scaffold tower legs.

2. The adjustable scaffold base in accordance with claim 1, wherein the engaging component further comprises a substantially planar base plate secured to a lowermost end of at least one of the primary legs for engaging a surface upon which the scaffold base stands.

3. The adjustable scaffold base in accordance with claim 1, wherein the engaging component further comprises a swivel plate secured to a lowermost end of at least one of the primary legs for engaging a surface upon which the scaffold base stands.

4. The adjustable scaffold base in accordance with claim 1, wherein the engaging component further comprises a leveling jack secured to a lowermost end of at least one of the primary legs for engaging a surface upon which the scaffold base stands and for allowing the height of the primary leg to be adjusted.

5. The adjustable scaffold base in accordance with claim 1, wherein the primary leg sleeves of the lateral beams are removably secured to the primary legs by removable pins passing through pairs of aligned holes that extend through the primary leg sleeves and the primary legs.

6. The adjustable scaffold base in accordance with claim 1, further comprising mounting brackets that are rigidly affixed to the frame beams and that abut the lateral beams, wherein the frame beams are removably secured to the lateral beams by removable pins passing through pairs of aligned holes that extend through the mounting brackets and the lateral beams.

7. The adjustable scaffold base in accordance with claim 1, wherein the auxiliary legs and the primary legs are at least about five feet in length, thereby permitting the frame and lateral beams to be raised to almost five feet above the support surface.

8. The adjustable scaffold base in accordance with claim 1, wherein each of the auxiliary legs terminates in a caster for engaging the support surface.

9. The adjustable scaffold base in accordance with claim 8, wherein each auxiliary leg is secured to its respective auxiliary leg sleeve by a removable pin passing through pairs of aligned holes that extend through the auxiliary leg sleeves and the auxiliary legs.

10. An adjustable scaffold base supporting a scaffold tower formed of scaffold frames in an elevated position above a support surface, the scaffold tower having at least four downwardly extending, spaced scaffold tower legs, the scaffold base comprising:

(a) first, second, third and fourth elongated, upstanding primary legs in a, spaced relationship with one another, the lower end of each primary leg having an engaging component seating against the support surface;

(b) a first lateral beam extending transversely between and connected to the first and second primary legs and a second, spaced lateral beam extending transversely between and connected to the third and fourth primary legs;

(c) first and second spaced frame beams extending transversely across, and connected between the primary leg sleeves to, the first and second lateral beams;

(d) auxiliary leg sleeves rigidly affixed, and transverse, to ends of the corresponding frame beams;

(e) elongated auxiliary legs extending through a respective one of the auxiliary leg sleeves, a lowermost end of each auxiliary leg terminating in a component for engaging the support surface, wherein each auxiliary leg is slidably mounted within its respective auxiliary leg sleeve; and wherein a pair of spaced frame posts extend transversely from each frame beam between the auxiliary leg sleeves and the primary leg sleeves and engaging and supporting the scaffold tower legs.

11. The adjustable scaffold base in accordance with claim 10, wherein each of the primary legs extends through one of four respective primary leg sleeves rigidly affixed to ends of the corresponding lateral beams, whereby each primary leg sleeve slideably surrounds its respective primary leg to permit each lateral beam to move along the length of its respective primary legs except when each primary leg sleeve is removably secured at one of a plurality of positions along the length of its respective primary leg.

12. The adjustable scaffold base in accordance with claim 11, wherein the primary leg sleeves of the lateral beams are removably secured to the primary legs by removable pins passing through pairs of aligned holes that extend through the primary leg sleeves and the primary legs.

13. The adjustable scaffold base in accordance with claim 10, wherein each frame beam is removably secured at a position along the length of each lateral beam.

14. The adjustable scaffold base in accordance with claim 13, further comprising mounting brackets rigidly affixed to the frame beams that abut the lateral beams, wherein the frame beams are removably secured to the lateral beams by removable pins passing through pairs of aligned holes that extend through the mounting brackets and the lateral beams.

15. The adjustable scaffold base in accordance with claim 10, wherein the engaging component further comprises a substantially planar base plate secured to a lowermost end of at least one of the primary legs for engaging a surface upon which the scaffold base stands.

16. The adjustable scaffold base in accordance with claim 10, wherein the engaging component further comprises a swivel plate secured to a lowermost end of at least one of the primary legs for engaging a surface upon which the scaffold base stands.

17. The adjustable scaffold base in accordance with claim 10, wherein the engaging component further comprises a leveling jack secured to a lowermost end of at least one of the primary legs for engaging a surface upon which the scaffold base stands and for allowing the height of the primary leg to be adjusted.

18. The adjustable scaffold base in accordance with claim 10, wherein the auxiliary legs and the primary legs are at least about five feet in length, thereby permitting the frame and lateral beams to be raised to almost five feet above the support surface.

19. The adjustable scaffold base in accordance with claim 10, wherein the component engaging the support surface further comprises a lowermost end of each auxiliary leg terminating in a caster for engaging the surface upon which the scaffold base stands, and wherein each auxiliary leg is secured to its respective auxiliary leg sleeve in the desired position.

20. The adjustable scaffold base in accordance with claim 19, wherein the position of each auxiliary leg is secured to its respective auxiliary leg sleeve by a removable pin passing through pairs of aligned holes that extend through the auxiliary leg sleeves and the auxiliary legs.

21. A method of using an adjustable scaffold base to support a scaffold tower formed of scaffold frames in an elevated position above a support surface, the scaffold tower having at least four downwardly extending, spaced scaffold tower legs, the method comprising:

(a) extending first and second elongated, upstanding primary legs through first and second respective primary leg sleeves rigidly affixed to ends of a first lateral beam that extends between the first and second primary legs and seating the lower end of each primary leg against the support surface;

(b) extending the third and fourth elongated, upstanding primary legs through third and fourth respective primary leg sleeves rigidly affixed to ends of a second lateral beam that is spaced from the first lateral beam that extends between the third and fourth primary legs and seating the lower end of each primary leg against the support surface, whereby the primary leg sleeves slidably surround their respective primary legs to permit the first and second lateral beams to move along the primary legs except when the primary leg sleeves are removably secured to the primary legs;

(c) removably securing first and second spaced frame beams transversely across the first and second lateral beams between the primary leg sleeves;

(d) extending elongated auxiliary legs through auxiliary leg sleeves that are rigidly attached to ends of the frame beams with a lower end of each auxiliary leg engaging the support surface, wherein each auxiliary leg is slidably mounted within its respective auxiliary leg sleeve; and (e) attaching the scaffold tower legs supportively to spaced frame posts that extend transversely from each frame beam between the auxiliary leg sleeves and the primary leg sleeves.

22. The method in accordance with claim 21, further comprising:

(a) removing at least one of the frame beams from attachment to the lateral beams at an original position, and then removably securing said at least one frame beam to the first and second lateral beams at a second position spaced from the original position;

(b) withdrawing the lower ends of the primary legs from contacting the support surface; and (c) moving the combination of the scaffold base and the scaffold tower along the support surface while the auxiliary legs support the weight thereof, and the primary legs support substantially no weight.

23. The method in accordance with claim 22, further comprising disposing wheels at the lower ends of the auxiliary legs prior to the moving step.

24. The method in accordance with claim 22, further comprising the step of removably securing said at least one frame beam to the first and second lateral beams at a second position after first determining, and based on, the distance between two substantially unobstructed paths so the auxiliary legs have substantially unobstructed paths through which to move.

* * * * *